US010772393B1

(12) United States Patent
Cao

(10) Patent No.: US 10,772,393 B1
(45) Date of Patent: Sep. 15, 2020

(54) WEARABLE DEVICE

(71) Applicants: HONGFUJIN PRECISION ELECTRONICS (ZHENGZHOU) CO., LTD., Zhengzhou (CN); HON HAI PRECISION INDUSTRY CO., LTD., New Taipei (TW)

(72) Inventor: Yan-Lei Cao, Zhengzhou (CN)

(73) Assignees: HONGFUJIN PRECISION ELECTRONICS (ZHENGZHOU) CO., LTD., Zhengzhou (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/363,743

(22) Filed: Mar. 25, 2019

(30) Foreign Application Priority Data

Feb. 25, 2019 (CN) ..... 2019 2 0233153 U

(51) Int. Cl.
*A44B 17/00* (2006.01)

(52) U.S. Cl.
CPC ..... *A44B 17/0011* (2013.01)

(58) Field of Classification Search
CPC ..... A44B 17/0011; F16B 2/10; A44C 5/22; Y10T 24/45267; Y10T 24/45016; Y10T 24/45529; Y10T 24/45534; Y10T 24/45188
See application file for complete search history.

(56) References Cited

U.S. PATENT DOCUMENTS 731,707 A * 6/1903 Putnam ..... B60D 1/50 280/486
4,924,562 A * 5/1990 Pogharian ..... A44C 5/2052 24/647
5,136,858 A * 8/1992 Bruner ..... A44C 5/2042 24/650
6,370,914 B1 * 4/2002 Bruner ..... A44C 9/0046 63/15
6,481,069 B1 * 11/2002 Cheng ..... A44C 5/2038 24/537
6,508,080 B1 * 1/2003 Ninomiya ..... A44C 5/2042 24/574.1
7,878,024 B2 * 2/2011 Baik ..... A44C 7/00 24/574.1
8,375,532 B2 * 2/2013 Yakubovich ..... A44C 5/2033 24/650

(Continued)

*Primary Examiner* — Robert Sandy
*Assistant Examiner* — Rowland Do
(74) *Attorney, Agent, or Firm* — ScienBiziP, P.C.

(57) ABSTRACT

A wearable device includes a device main body and a connection structure. The device main body includes a snap portion configured to snap with the connection structure. The connection structure includes a main body, a fastening assembly, and a pressing member. The main body defines a fastening groove. The fastening assembly is rotationally mounted within the fastening groove. The fastening assembly includes a first end portion and a second end portion. The fastening assembly includes a latching portion protruding from the first end portion. The latching portion is configured to snap with the snap portion. The pressing member is arranged on the second end portion of the fastening assembly. When the second end portion is pressed, the first end portion is rotated away from the snap portion to disengage the latching portion from the snap portion.

17 Claims, 4 Drawing Sheets

(56) References Cited

U.S. PATENT DOCUMENTS

| | | | | |
|---|---|---|---|---|
| 9,066,616 | B2 * | 6/2015 | Yap | A45C 13/1092 |
| 2003/0066171 | A1 * | 4/2003 | Terzian | A44C 5/2061<br>24/647 |

* cited by examiner

WEARABLE DEVICE

FIELD

The subject matter herein generally relates to wearable devices, and more particularly to a wearable device having a connection structure.

BACKGROUND

Smart wearable devices, such as smart watches, bracelets, glasses, and necklaces, are becoming more and more popular. The existing smart necklaces in the related art include a lanyard detachably coupled to a necklace body. The lanyard is wrapped around a user's neck, and the necklace body may be used while walking or running. However, the main body of the smart necklace is prone to rotate relative to the lanyard when the main body is not held in place.

BRIEF DESCRIPTION OF THE DRAWINGS

Implementations of the present disclosure will now be described, by way of embodiments, with reference to the attached figures.

DETAILED DESCRIPTION

Figure 1:
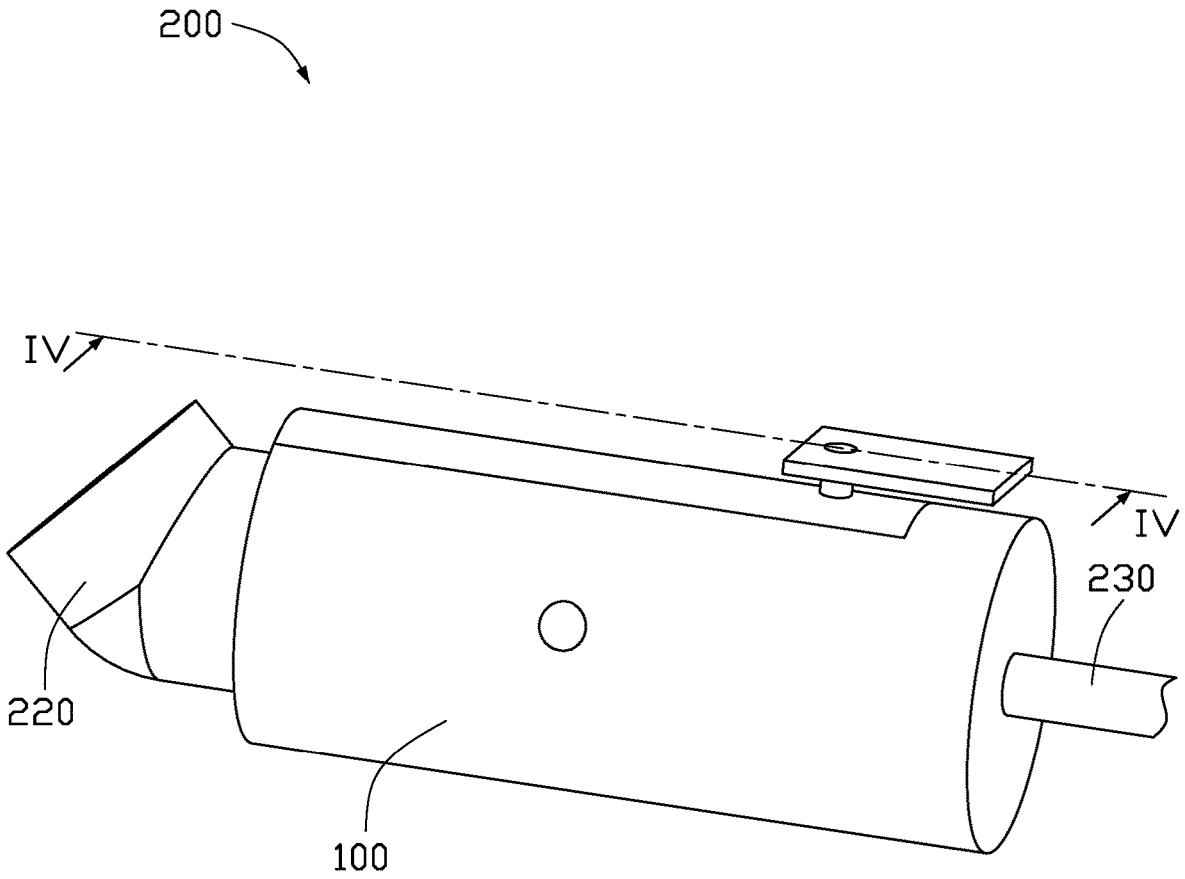
FIG. 1 is an assembled, isometric view of an embodiment of a wearable device including a connection structure.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series and the like.

FIG. 1 shows an embodiment of a wearable device 200 that includes a connection structure 100.

Figure 2:
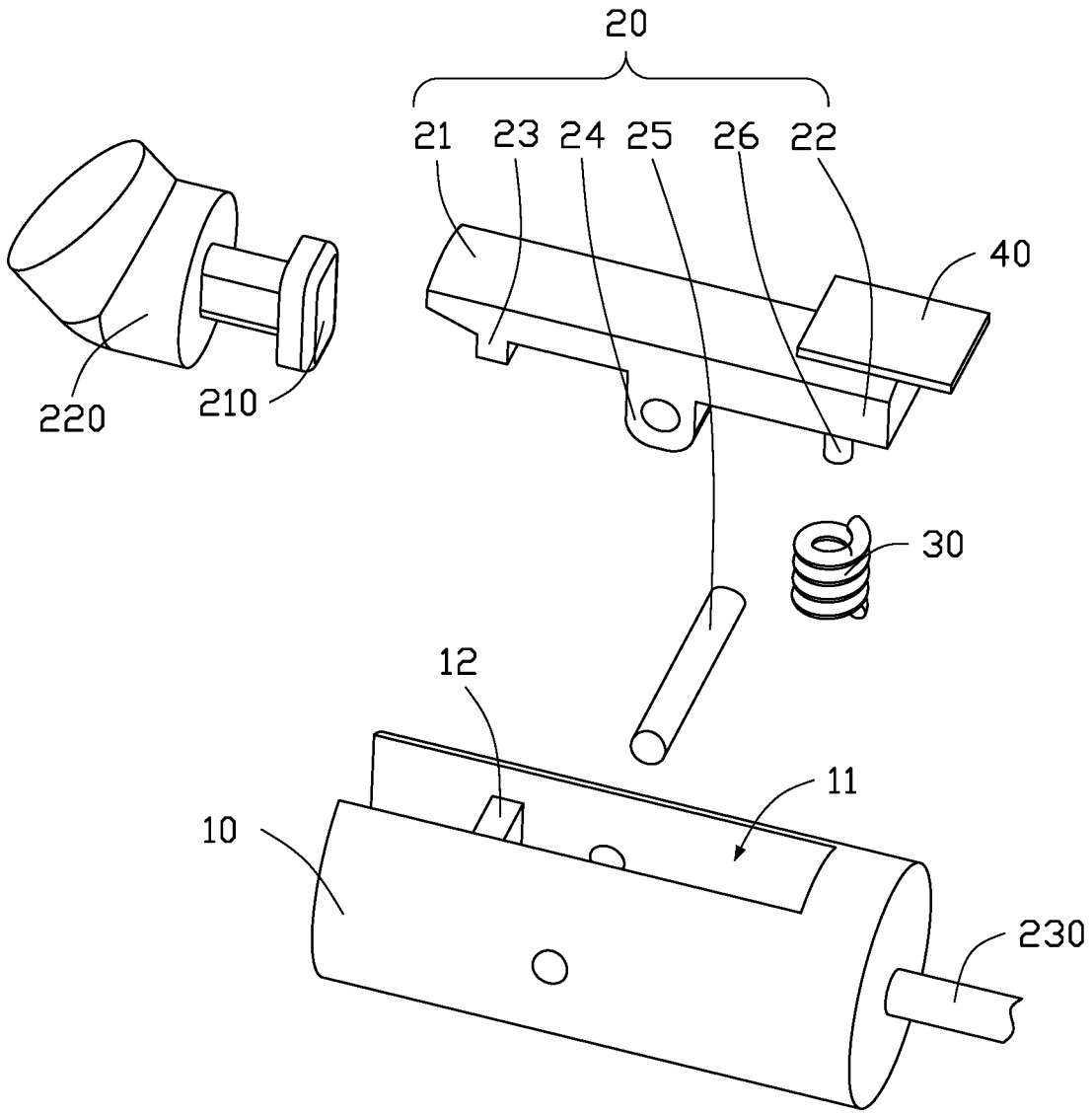
FIG. 2 is an exploded, isometric view of the wearable device in FIG. 1.

Referring to FIG. 2, the connection structure 100 includes a main body 10, a fastening assembly 20, a pressing member 30, and a movable piece 40. The main body 10 includes a fastening groove 11. The fastening assembly 20 is rotationally mounted in the fastening groove 11 of the main body 10. The fastening assembly 20 includes a first end portion 21 and a second end portion 22. The first end portion 21 and the second end portion 22 are respectively opposite ends of the fastening assembly 20. A latching portion 23 protruding from the first end portion 21. The pressing member 30 is located on the second end portion 22. One end of the movable piece 40 is rotationally coupled to the second end portion 22 on a side of the fastening assembly 20 facing away from the latching portion 23. The movable piece 40 extends beyond the second end portion 22.

The wearable device 200 further includes a snap portion 210, a device main body 220, and a connecting member 230 configured to snap-fit with the connection structure 100. The snap portion 210 has a substantially T-shaped cross-section and protrudes from one side of the device main body 220. The device main body 220 is snap-fitted with the latching portion 23 of the connection structure 100 by the snap portion 210 on one end of the main body 10. The connecting member 230 is fixedly coupled to a second end of the main body 10 away from the device main body 220. In one embodiment, the connecting member 230 is a connecting cord which can be worn on the neck of a user.

In other embodiments, the snap portion 210 can be a recess, and the latching portion 23 of the fastening assembly 20 can be engaged in the snap portion 210.

The fastening assembly 20 is configured to rotate in the fastening groove 11, so that the first end portion 21 of the fastening assembly 20 rotates away from the snap portion 210 to disengage the latching portion 23 from the snap portion 210.

The main body 10 is substantially cylindrical. The fastening groove 11 has a substantially rectangular cross-section and extends from one end of the main body 10 to another end of the main body 10 along an axis of the main body 10. One end of the fastening groove 11 penetrates an end surface of the main body 10. A blocking portion 12 is located in the fastening groove 11. The blocking portion 12 is configured to limit movement of the latching portion 23 in the fastening groove 11.

In other embodiments, the fastening groove 11 may penetrate both ends of the main body 10 along the axis of the main body 10.

In other embodiments, the cross-sectional shape of the fastening groove 11 may be a triangle, a pentagon, a hexagon, or other shape, as long as the cross-sectional shape of the snap portion 210 is the same as the cross-sectional shape of the fastening groove 11 and can be fastened in the fastening groove 11.

The fastening assembly 20 is substantially elongated. The latching portion 23 can be snap-fitted with the snap portion 210 to fix the device main body 220 in the fastening groove 11. The fastening assembly 20 includes a rotating portion 24. The rotating portion 24 is substantially lug-shaped. The number of the rotating portions 24 is two, and the two rotating portions 24 are arranged in parallel and spaced apart. The two rotating portions 24 are rotationally coupled to the main body 10 through a rotary shaft 25 inside the fastening groove 11. The first end portion 21 and the second end portion 22 are respectively located on opposite sides of the rotating portion 24.

The fastening assembly 20 further includes a limiting portion 26. The limiting portion 26 is substantially cylindrical-shaped. The limiting portion 26 extends from the second end portion 22 and is configured to prevent the pressing member 30 from rotating.

In other embodiments, the limiting portion 26 can be a groove-shaped structure arranged on the second end portion 22, and one end of the pressing member 30 is locked in the groove structure to prevent the pressing member 30 from rotating.

The pressing member 30 is made of an elastic material. One end of the pressing member 30 abuts against the second end portion 22 of the fastening assembly 20, and a second end abuts against the main body 10 in the fastening groove 11. In one embodiment, the pressing member 30 is a spring and is sleeved on the limiting portion 26.

Figure 3:
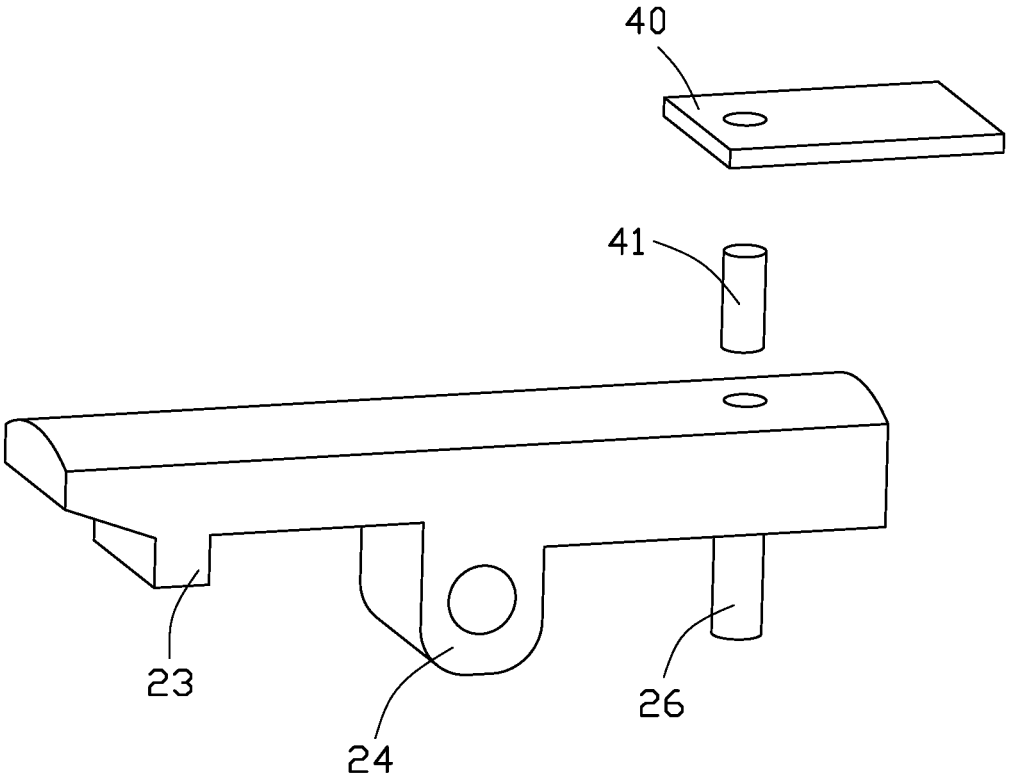
FIG. 3 is a partial exploded view of a fastening assembly of the connection structure.

Referring to FIGS. 1-3, one end of the movable piece 40 is rotationally coupled to a side of the fastening assembly 20 facing away from the latching portion 23 by a pin 41, and a second end of the movable piece 40 is configured to overlap with an end of the main body 10 adjacent to the pressing member 30.

Figure 4:
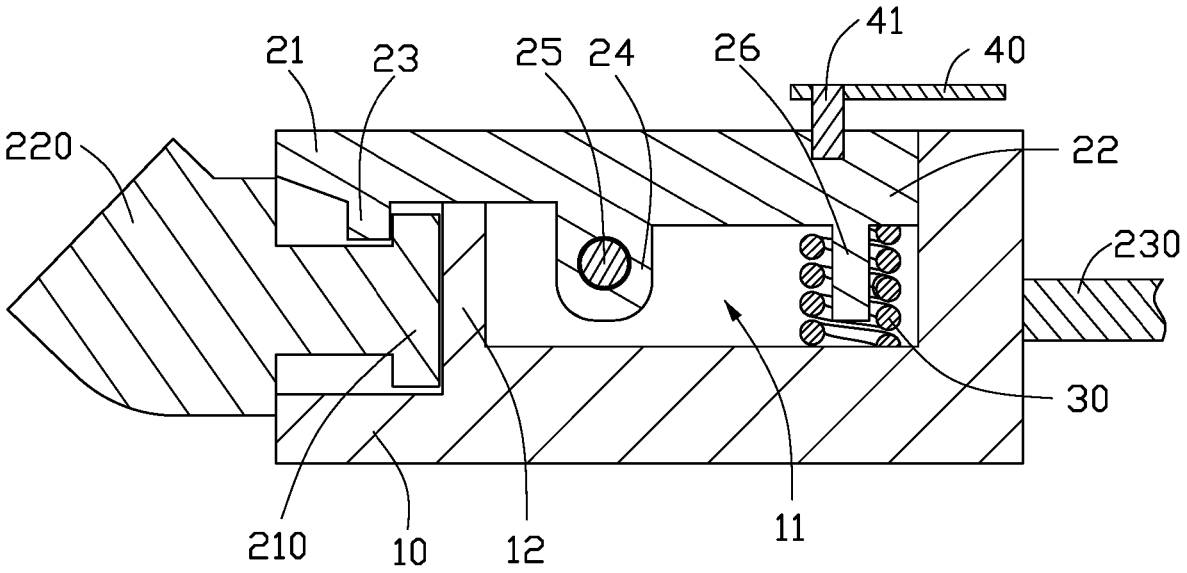
FIG. 4 is a cross-sectional view of the wearable device taken along line IV-IV in FIG. 1.

Referring to FIG. 4, to fasten the device main body 220 to the main body 10, the movable piece 40 is first rotated to position both ends of the movable piece 40 above the fastening assembly 20, the second end portion 22 of the fastening assembly 20 is pressed to fasten the snap portion 210 of the main body 220 with the latching portion 23 of the connection structure 100, and then the movable piece 40 is rotated to overlap the second end of the movable piece 40 with the main body 10. The second end of the movable piece 40 overlapped with the main body 10 prevents inadvertently pressing the second end portion 22 of the fastener 20 during use to disengage the device main body 220 from the connection structure 100. The connecting member 230 is coupled to one end of the main body 10 away from the latching portion 23. The snap portion 210 engaged between the latching portion 23 and the blocking portion 12 restrains movement of the snap portion 210.

Compared with the related art, the first end portion 21 of the fastening assembly 20 can be rotated away from the snap portion 210 by pressing the second end portion 22 of the fastening assembly 20 to disengage the latching portion 23 from the snap portion 210. Thus, the latching portion 23 is easily disengaged from the snap portion 210, and a snap-fit coupling between the snap portion 210 and the latching portion 23 prevents the wearable device 200 from rotating during use.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A wearable device comprising:
a device main body; and
a connection structure; wherein:
the device main body comprises a snap portion;
the connection structure comprises a main body, a fastening assembly, and a pressing member;
the main body defines a fastening groove;
the fastening assembly is rotationally mounted within the fastening groove;
the fastening assembly comprises a first end portion and a second end portion;
the fastening assembly comprises a latching portion protruding from the first end portion;
the latching portion is configured to snap with the snap portion;
the pressing member is arranged on the second end portion of the fastening assembly;
when the second end portion is pressed, the pressing member is pressed, and the first end portion is rotated away from the snap portion to disengage the latching portion from the snap portion;
when the second end portion is released, the pressing portion restores a position of the second end portion;
the fastening assembly further comprises a movable piece;
one end of the movable piece is rotationally coupled to the second end portion on a side of the fastening assembly facing away from the latching portion;
a second end of the movable piece is configured to overlap with an end portion of the main body adjacent to the pressing member.

2. The wearable device of claim 1, wherein:
the fastening assembly comprises a limiting portion extending from the second end portion;
the limiting portion is configured to keep the pressing member from rotating.

3. The wearable device of claim 1, wherein:
a cross-sectional shape of the fastening groove matches a cross-sectional shape of the snap portion.

4. The wearable device of claim 1, wherein:
the pressing member is made of elastic material.

5. The wearable device of claim 1, wherein:
the pressing member is a spring.

6. The wearable device of claim 1, wherein:
the main body comprises a blocking portion within the fastening groove;
the blocking portion is configured to limit movement of the latching portion in the fastening groove.

7. The wearable device of claim 1, wherein:
the fastening assembly is rotationally coupled to the main body in the fastening groove by a rotary shaft.

8. The wearable device of claim 1, wherein:
the fastening groove extends from one end of the main body to a second end of the main body.

9. The wearable device of claim 8, wherein:
the fastening groove penetrates one end of the main body; and
the snap portion is received from the end of the main body through the fastening groove.

10. A wearable device comprising:
a device main body; and
a connection structure; wherein:
the device main body comprises a snap portion configured to snap with the connection structure;
the connection structure comprises a main body, a fastening assembly, and a pressing member;
the main body defines a fastening groove;
the fastening assembly is rotationally mounted within the fastening groove;
the fastening assembly comprises a rotating portion, a first end portion, and a second end portion;
the first end portion and the second end portion are respectively located on opposite sides of the rotating portion;

the fastening assembly comprises a latching portion protruding from the first end portion;

the latching portion is configured to snap with the snap portion within the fastening groove;

the pressing member is arranged on the second end portion of the fastening assembly;

when the second end portion is pressed, the fastening assembly rotates about the rotating portion, and the first end portion is rotated away from the snap portion to disengage the latching portion from the snap portion;

the main body comprises a blocking portion within the fastening groove;

the blocking portion is located between the latching portion and the rotating portion;

the blocking portion is configured to limit movement of the latching portion in the fastening groove;

the fastening assembly further comprises a movable piece;

one end of the movable piece is rotationally coupled to the second end portion on a side of the fastening assembly facing away from the latching portion;

a second end of the movable piece is configured to overlap with an end portion of the main body adjacent to the pressing member.

11. The wearable device of claim 10, wherein:

the fastening assembly comprises a limiting portion extending from the second end portion;

the rotating portion is located between the latching portion and the limiting portion;

the pressing member is sleeved on the limiting portion, such that one end of the pressing member abuts against the second end portion, and a second end of the pressing member abuts against the main body within the fastening groove.

12. The wearable device of claim 11, wherein:

a cross-sectional shape of the fastening groove matches a cross-sectional shape of the snap portion.

13. The wearable device of claim 10, wherein:

the pressing member is made of elastic material.

14. The wearable device of claim 10, wherein:

the pressing member is a spring.

15. The wearable device of claim 10, wherein:

the fastening assembly is rotationally coupled to the main body in the fastening groove by a rotary shaft passing through the rotating portion of the fastening assembly.

16. The wearable device of claim 15, wherein:

the fastening groove extends from one end of the main body to a second end of the main body and extends along an axis of the main body.

17. The wearable device of claim 16, wherein:

the fastening groove penetrates one end of the main body; and the snap portion is received by the end of the main body through the fastening groove.

* * * * *